US010590661B2

(12) United States Patent
Pucilowski

(10) Patent No.: US 10,590,661 B2
(45) Date of Patent: Mar. 17, 2020

(54) OVERLAY PLACEMENT USING AN UNCOUPLING MAT

(71) Applicant: LATICRETE INTERNATIONAL, INC., Bethany, CT (US)

(72) Inventor: Eric Pucilowski, Clarks Summit, PA (US)

(73) Assignee: Laticrete International Inc., Bethany, CT (US)

( * ) Notice: Subject to any disclaimer, the term of this patent is extended or adjusted under 35 U.S.C. 154(b) by 0 days.

(21) Appl. No.: 16/145,903

(22) Filed: Sep. 28, 2018

(65) Prior Publication Data

US 2019/0100925 A1 Apr. 4, 2019

Related U.S. Application Data

(60) Provisional application No. 62/565,686, filed on Sep. 29, 2017.

(51) Int. Cl.
*E04F 15/12* (2006.01)
*E04F 15/18* (2006.01)

(52) U.S. Cl.
CPC ..... *E04F 15/12* (2013.01); *E04F 15/185* (2013.01)

(58) Field of Classification Search
CPC ..... E04F 15/12; E04F 15/185
See application file for complete search history.

(56) References Cited

U.S. PATENT DOCUMENTS 5,052,161 A * 10/1991 Whitacre ..... E04F 15/18 52/385
6,151,854 A * 11/2000 Gutjahr ..... E04D 13/0477 52/385
2007/0234652 A1* 10/2007 Shaw ..... E01C 11/24 52/181
2017/0292278 A1* 10/2017 Gutjahr ..... E04F 15/182

* cited by examiner

*Primary Examiner* — Patrick J Maestri
(74) *Attorney, Agent, or Firm* — DeLio Peterson & Curcio LLC; Kelly M. Nowak

(57) ABSTRACT

Methods, systems and polished overlays utilizing an uncoupling membrane between a substrate (e.g., floor) and a deposited polishable overlay. The overlay may be a self-leveling, polishable overlay. An uncoupling membrane is secured to a substrate followed by directly depositing a polishable overlay over and contacting the uncoupling membrane. The uncoupling membrane secures the polishable overlay to the substrate without use of a primer/broadcast sand layer. The polishable overlay may fill voids in the uncoupling membrane and may be deposited over the uncoupling membrane to a thickness residing above a top surface of the uncoupling membrane. The polishable overlay may be polished once cured whereby the uncoupling membrane reduces stresses in the overlay layer during polishing.

20 Claims, 5 Drawing Sheets

OVERLAY PLACEMENT USING AN UNCOUPLING MAT

BACKGROUND

The present invention relates to polishable cementitious materials, and in particular, polished overlay floorings, systems and methods for applying polishable overlays directly over an uncoupling membrane/mat for adhesion to the membrane and/or to the underlying floor surface.

DESCRIPTION OF THE PREFERRED EMBODIMENT(S)

A polished (polishable) overlay is a cementitious self-leveling material that is typically poured over a floor and then polished to provide a smooth and/or a decorative flooring surface. Polishable overlays are used when the look of polished concrete is desired but not obtainable with the existing floor. These coatings may be applied over old flooring to cover up concrete floors having imperfections or flaws. Such imperfections or flaws may include, for instance, unevenness, lack of flatness, contamination, holes, cracks, carpet tack holes, extensive patchwork, undesired coloring, remodeling, height issues, the existing floor is unable to yield the desired aesthetic effect, and other variations. Polishable overlays may also be applied over new flooring to provide a smooth, decorative flooring surface. Known polishable overlays may be provided with coloring or dyes, aggregates, decorative particles as well as design features to provide a decorative polished concrete flooring.

Polishable overlays are applied as a thin coating of approximately ⅜-inch over an existing concrete slab or floor. Several preparations and steps must be taken to ensure proper application and bonding of such polishable overlays.

Initially in applying polishable overlays the existing concrete flooring (or slab) is profiled for any necessary repairs and/or cleaning of any contaminants, followed by application of a primer. These steps of repairing and removing contaminants before a primer can be applied to the flooring are time consuming and often lead to undesired release of airborne contaminants. Once the flooring is profiled by repair and/or cleaning of contaminants, such flooring is then primed using a material that helps adhesion and bonding of the subsequently applied polishable overlay. Typically, high-solids epoxy primers with broadcast sand are employed to provide a suitable bonding surface for the overlay. Another known primer is acrylic primers. However, acrylics are not used often since they do not provide sufficient crack-bridging capabilities and they do not prevent "pin-holing" affects caused by out-gassing of the underlying flooring, both of which affect the finished floor surface.

While polishable overlays have increased in popularity, the application of these overlays is difficult, time consuming, requires several processing steps, and often leads to undesired airborne particulates that may deleteriously affect workers applying the polishable overlays. As such, improved methods and systems are needed for easily, time efficiently, and safely applying polishable overlays over a flooring or substrate surface.

SUMMARY OF THE INVENTION

Bearing in mind the problems and deficiencies of the prior art, it is therefore an object of the present invention to provide methods applying polishable overlays over a flooring or substrate surface.

Another object of the present invention is to provide systems for applying polishable overlays over a flooring or substrate surface.

It is another object of the present invention to provide improved polished overlay flooring.

A further object of the invention is to provide methods and systems for easily, time efficiently, and safely applying polishable overlays over a flooring or substrate surface.

It is yet another object of the present invention to provide improved polished overlay flooring having reduced hazardous health risks during application thereof.

Still other objects and advantages of the invention will in part be obvious and will in part be apparent from the specification.

The above and other objects, which will be apparent to those skilled in the art, are achieved in the present invention which is directed to methods of installing a self-leveling overlay by identifying a substrate for covering with a self-leveling overlay, and securing an uncoupling membrane to the substrate. A polishable overlay may then be directly deposited over and contacting the uncoupling membrane to secure the polishable overlay to the substrate. The polishable overlay fills any voids in the uncoupling membrane and may be deposited over the uncoupling membrane to a thickness residing above a top surface of the uncoupling membrane. The methods may further include inspecting the substrate for flaws, and repairing identified flaws of the substrate prior to securing the uncoupling membrane to the substrate.

In one or more embodiments the substrate may be flooring. The uncoupling membrane may include a number of recesses residing across a surface area thereof, whereby the polishable overlay fills the number of recesses. The uncoupling membrane may further include a number of openings residing across the surface area thereof, whereby the polishable overlay deposits into the number of openings. Still further, the uncoupling membrane may include a fabric-like mat attached to an underside thereof, whereby the number of openings exposing the fabric-like mat whereby the polishable overlay contacts and bonds to the fabric-like mat through the number of openings.

In other embodiments of the invention, the uncoupling membrane may include a number of raised protrusions residing across a surface area thereof with recess regions residing between the raised protrusions. The polishable overlay fills these recess regions. In these embodiments, the uncoupling membrane may further include a number of openings residing across the surface area thereof. Still further, the uncoupling membrane may include a fabric-like mat attached to an underside thereof, whereby the number of openings expose the fabric-like mat. The polishable overlay contacts and bonds to the fabric-like mat through these number of openings.

In embodiments of the invention the polishable overlay may be directly poured onto the uncoupling membrane without a primer layer residing between the polishable overlay and the uncoupling mat. The polishable overlay may also be directly poured onto the uncoupling membrane without an epoxy primer layer residing between the polishable overlay and the uncoupling mat. In other embodiments the polishable overlay may be directly poured onto the uncoupling membrane without an epoxy primer/broadcast sand layer residing between the polishable overlay and the uncoupling membrane. That is, use of an epoxy layer and a broadcast sand layer are avoided.

In one or more embodiments the methods may further include the substrate being a cementitious substrate, and applying mortar over the cementitious substrate. The uncoupling membrane is provided over the mortar to secure the uncoupling membrane to the cementitious substrate. The polishable overlay may then be directly poured over and contact the uncoupling membrane to secure the polishable overlay to the cementitious substrate without use of a primer/broadcast sand layer. The methods may further include inspecting the cementitious substrate for flaws, and repairing identified flaws of the cementitious substrate prior to applying the mortar and the uncoupling membrane.

In the invention the polishable overlay may fill any voids in the uncoupling membrane and may be deposited over the uncoupling membrane to the thickness of about 1.5-76 mm over the top surface of the uncoupling membrane. The top surface of the deposited polishable overlay may be polished to provide a polished self-leveling overlay, wherein the uncoupling membrane reduces stresses applied to the polishable overlay during polishing. Together, the substrate, uncoupling membrane, and polished self-leveling overlay provide a finished polished overlay flooring, whereby the reduced stresses reduce cracking and detachment of the finished polished overlay flooring.

The invention is also directed to a system of an overlay placement that includes a substrate, an uncoupling membrane secured to the substrate, and a polishable overlay residing directly over and contacting the uncoupling membrane. The uncoupling membrane secures the polishable overlay to the substrate without use of a primer/broadcast sand layer. The polishable overlay may fill voids in the uncoupling membrane and may be deposited over the uncoupling membrane to a thickness residing above a top surface of the uncoupling membrane.

Still further, the invention is directed to a polished overlay flooring that includes an existing floor, an uncoupling membrane secured to the existing floor, and a polishable overlay residing directly over and contacting the uncoupling membrane. The uncoupling membrane secures the polishable overlay to the existing floor without use of a primer/broadcast sand layer. The polishable overlay may fill voids in the uncoupling membrane and may be deposited over the uncoupling membrane to a thickness residing above a top surface of the uncoupling membrane.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

In describing the preferred embodiment of the present invention, reference will be made herein to FIGS. 1-5B of the drawings in which like numerals refer to like features of the invention.

Conventional methods for applying polishable overlays involve inspection, preparation, repair, and/or dry time steps, all of which are labor intensive and time consuming. Some of these steps may even be detrimental to the health of people applying these layers or others near sites where applications occur. For instance, undesired airborne particulates, contaminants and fumes may be released as a result of some of these conventional polishable overlay applications.

Figure 1:
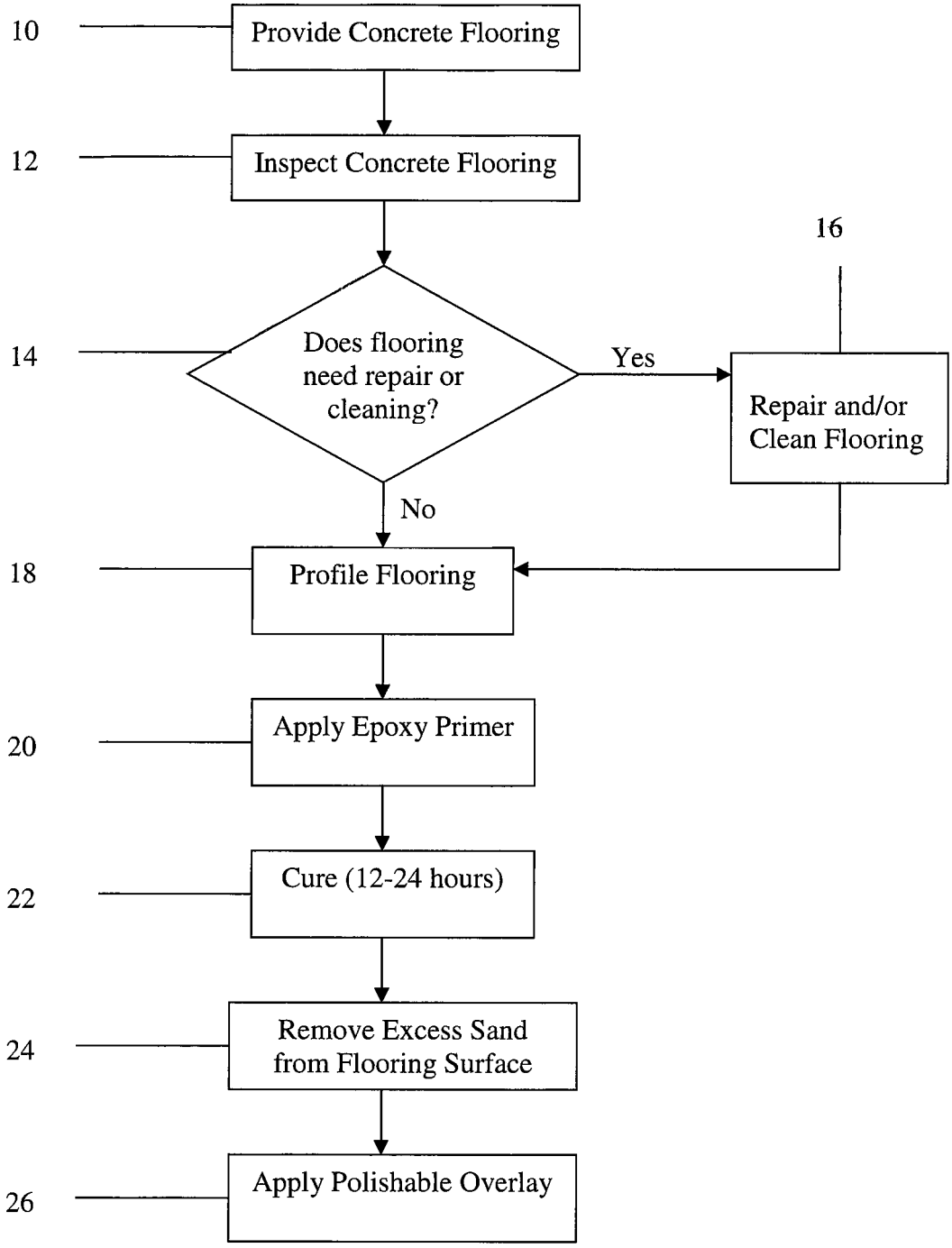
FIG. 1 PRIOR ART
FIG. 1 is a prior art process flow of applying polishable overlays.
Figure 2A:
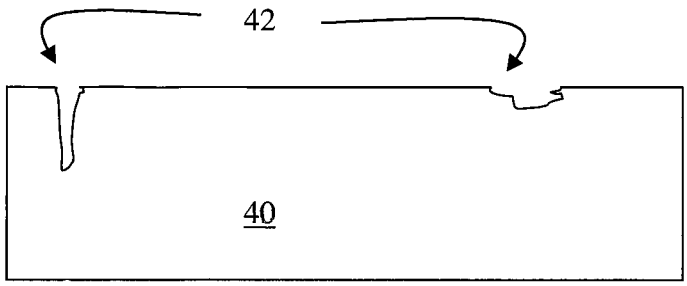
FIG. 2A PRIOR ART
FIGS. 2A-2E are prior art illustrations showing application of polishable overlays in accordance with the process flow of FIG. 1.
Figure 2B:
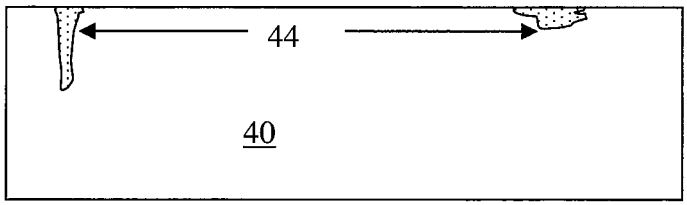
FIG. 2B PRIOR ART
Figure 2C:
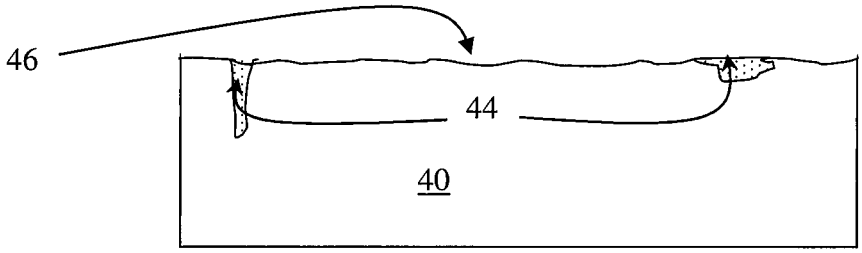
FIG. 2C PRIOR ART
Figure 2D:
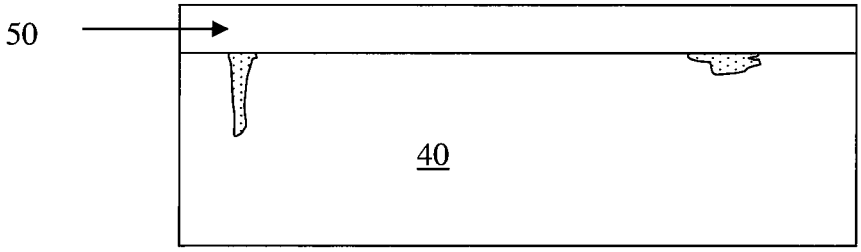
FIG. 2D PRIOR ART
Figure 2E:
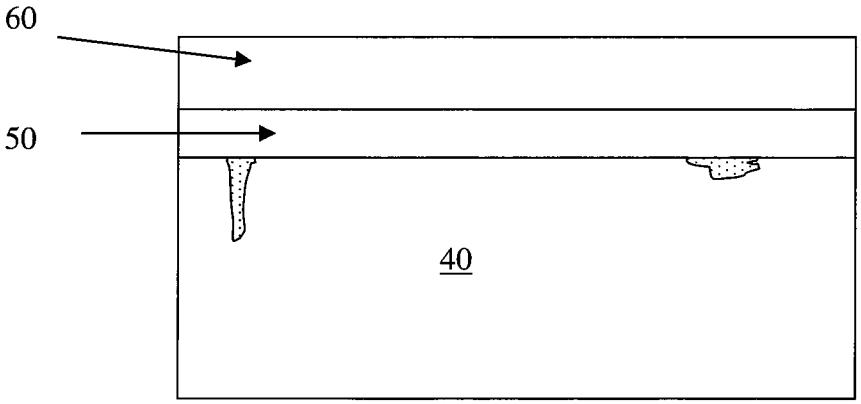
FIG. 2E PRIOR ART

Referring to FIGS. 1-2E, a prior art process flow for applying a polishable overlay is shown. Once a cementitious substrate is provided (step 10), it is inspected to determine its profile characteristics (step 12). The cementitious substrate may be a concrete or concrete-based slab or flooring (hereinafter referred to as "flooring 40".)

Upon inspection, it is determined whether the flooring needs to be repaired and/or cleaned (step 14). Instances when a flooring 40 as shown in FIG. 2A having flaws 42 needs repair may include, but are not limited to, the floor having unevenness, lack of flatness, contamination, holes, cracks, carpet tack holes, extensive patchwork, undesired coloring, height issues, the existing floor is unable to yield the desired aesthetic effect, or other undesired characteristics, imperfections, and/or flaws that would affect the finished flooring. The flooring may also be covered with debris, contaminants, and/or other constituents that need to be removed/cleaned from the floor or floor surface prior to applying the polishable overlay.

If it is determined that the flooring 40 needs to be repaired and/or cleaned, appropriate steps and actions are taken to repair or clean the flooring (step 16). For instance, referring to FIG. 2B in repairing the flooring 40, flaws 42 such as holes and cracks may be filled with a filler material (e.g., a cementitious filler, acrylic-based filler, epoxy-based filler, etc.), flooring may be leveled for unevenness or height issues, and the like. The flooring may also need to be cleaned of any debris, dirt, hazardous material deposits, or contaminant materials that will deleteriously affect adhesion of the subsequently deposited primer and polishable overlay layers. These steps or repair and/or cleaning may take approximately 12-24 hours, or more, depending upon the action needed to be taken. Once all repairing and cleaning is complete, the process continues to profiling the flooring (step 18), typically by shot blasting the flooring or cementitious slab. If the flooring does not need to be repaired or cleaned, the process continues to the floor profiling step (step 18).

In the process of profiling the flooring, the existing flooring may be mechanically processed to yield a flooring surface profile that is suitable for epoxy primer. Known approaches of profiling (i.e., preparing) the floor include mechanically grinding the existing flooring using either a concrete grinder or a shot blast machine (usually CSP 4-5) to provide the desired surface area profile 46 for epoxy primer adhesion, as shown by the roughened surface 46 of FIG. 2C.

Referring to FIG. 2D, after the flooring has been prepared the epoxy primer 50 is applied on top of the prepared flooring surface (step 20). The epoxy primer is typically applied as a 2-part epoxy by mixing the epoxy and then rolling it onto the flooring surface. While the epoxy primer is wet a bed of sand is broadcast onto and into the epoxy layer. Typically, the broadcast sand fully covers the epoxy primer layer. This bed of broadcast sand is required for the bonding and adhesion of the polishable overlay to the epoxy layer. Once the wet epoxy layer is fully broadcast and covered with sand, the epoxy primer and sand overcoat must be cured until set or dry. In addition to the time it takes to apply the epoxy primer, the curing process (step 22) is time consuming often taking between 12-24 hours, or more, until the epoxy primer and sand are fully cured.

Once it is determined that the curing process of the epoxy and sand overcoat are complete, excess sand must then be removed from the cured surface (step 24). This step is very time consuming and labor intensive taking a day or more to complete since excess sand must be removed by surface scraping and then vacuuming. It is also often necessary to repeat this sand removal step several times until it is determined that the sand has been sufficiently removed. Another drawback of this step is that it releases particulate matter into the air, which may be hazardous to the worker's health (i.e., installer). For instance, health hazardous silica particles may become airborne and detrimentally inhaled by such workers, which are currently regulated and controlled by OSHA Regulations.

After it is determined that the excess sand removal is complete, as shown in FIG. 2E a mixed polishable overlay 60 is then directly poured (step 26) on top of the sand that has been broadcast into the epoxy primer layer (i.e. the primer/sand broadcast layer). The polishable overlay may be a self-leveling or trowel applied Portland cement-based overlay, calcium-aluminate overlay, or other fast-setting cements with trace amounts of polymer to complex polymer-modified formulas. Known polishable overlays may include coloring or dyes, hardeners and other reinforcing fibers. Polishable overlays may be applied with or without aggregates, decorative particles (e.g., glass or metal flakes), and/or design features to provide a decorative polished concrete flooring. The overlay is generally applied between ⅜ inch and ⅝-inch-thick, but it can be put down much thicker if necessary, up to 1.5 inches or more. When fully cured, polishable overlays may have a compressed strength ranging from about 4,000 psi to about 6,500.

Once curing of the polishable overlay is complete, this overlay layer is then polished. Typically, a planetary grinder is used to polish the overlay approximately 24 hours after the overlay has been deposited. This polishing step is performed to provide the resultant flooring layer with desired flatness, shine or other characteristics. However, during polishing the top of the overlay is removed during the grinding process, which may expose pinholes due to lack of primer (i.e., primer not fully deposited in some locations), visible sand segregation imperfections, or bubbles/holes due to air in the mix. Also, when using planetary grinders over conventionally laid polishable overlays, strong shear stresses are generated that may detrimentally affect a not fully cured overlay, leading to systematic problems with such overlays including delamination and/or cracking. Still other problems associated with current methods of applying polishable overlays is that they are very labor intensive and time consuming often requiring work to occur over a minimum of three (3) to five (5) days (or more), regardless of project size.

In view of the foregoing, known methods and systems for applying polishable overlays are less than ideal since they generate industry wide problems for manufacturers, installers (i.e., workers), and the end users. Also, in applying the polishable overlay over the epoxy primer/sand broadcast layer, if all loose sand is not removed from the flooring surface prior to application of the polishable overlay, then unwanted debonding occurs between the primer/sand broadcast layer and polishable overlay layer. There is also loss of bonding due to the curling nature during the curing process of cement-based products. The side effects that occur from this delamination include a hollow sounding floor and cracking, both of which are less than ideal in the final end product.

The various embodiments of the invention advantageously overcome the above problems by providing methods, polished overlay floorings, and systems of applying polishable overlays faster, easier, more time efficiently, and safer than known polishable overlay applications.

In accordance with the various embodiments of the invention, the invention avoids, or makes it not necessary, to apply an epoxy primer layer and/or a broadcast sand layer over the primer layer (e.g., primer/sand broadcast layer 50). As such, the invention avoids the need to wait for such primer/sand broadcast layers to cure, and the need for removal of any residual sand from the surface thereof. As such, the time it takes to apply the primer layer, the broadcasting of sand into such primer layer, cure time, and subsequent excess sand removal time are avoided. Also avoided is the detrimental health side affects caused by these steps, as well as the debonding or delamination between a primer/sand broadcast layer 50 and a polishable overlay 60.

Figure 3:
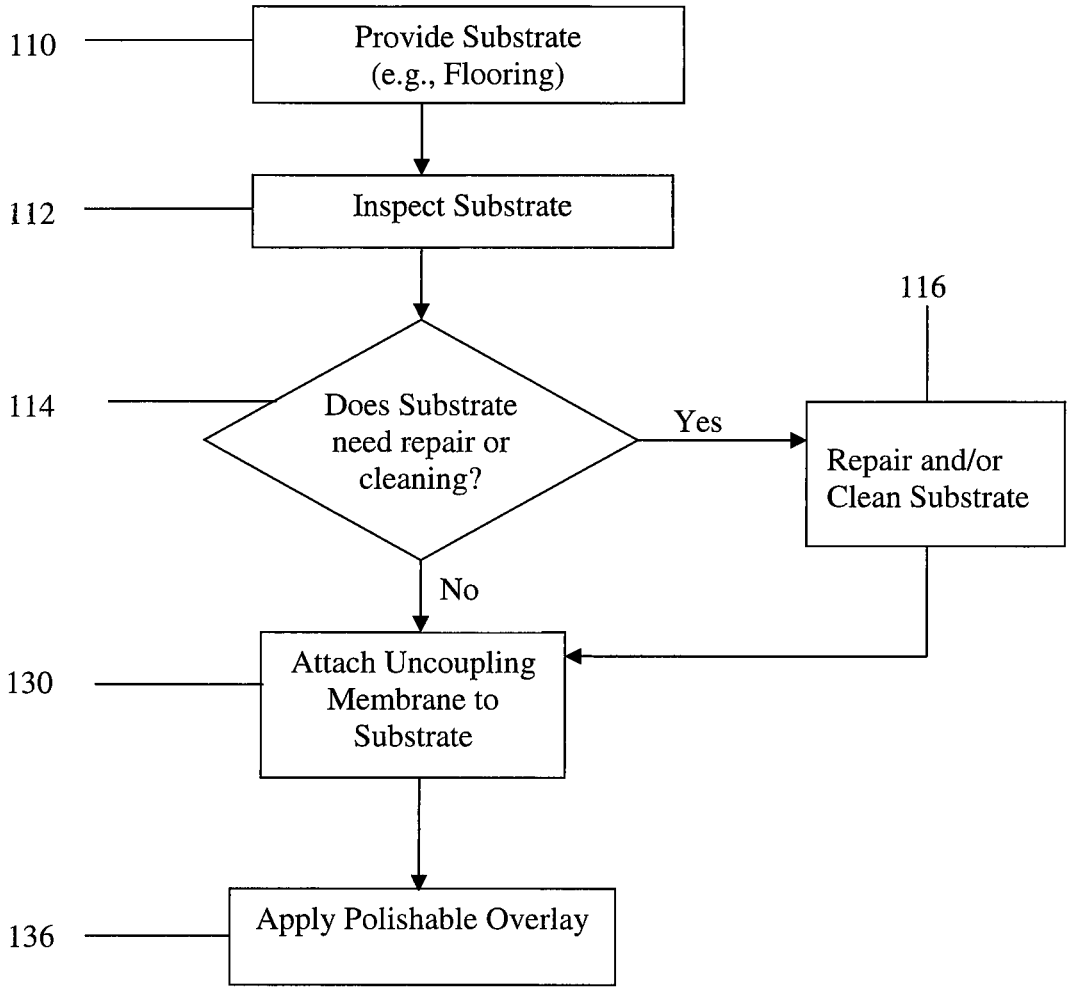
FIG. 3 is a process flow of applying polishable overlays in accordance with one or more embodiments of the invention.
Figure 4A:
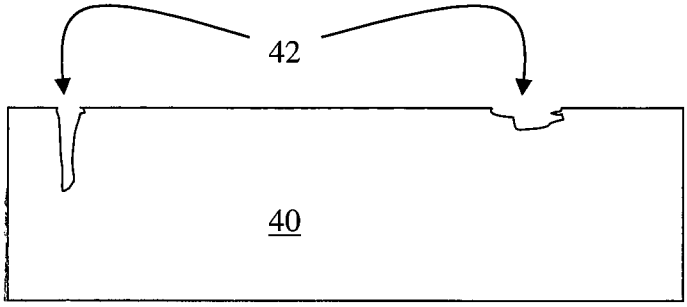
FIGS. 4A-4D are illustrations showing application of polishable overlays in accordance with process flows of the invention.
Figure 4B:
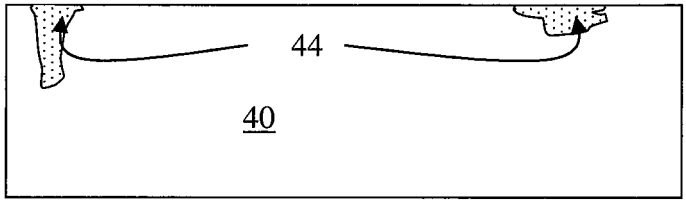
Figure 4C:
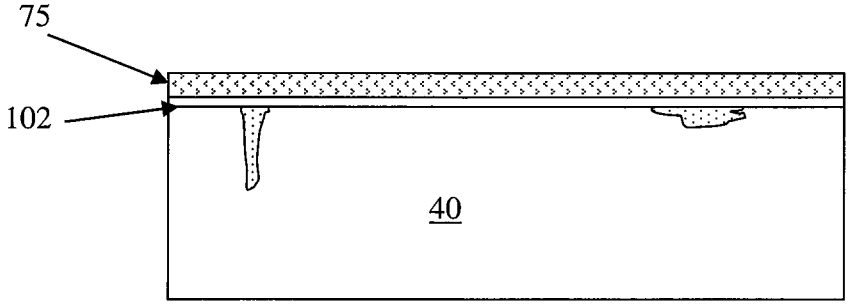
Figure 4D:
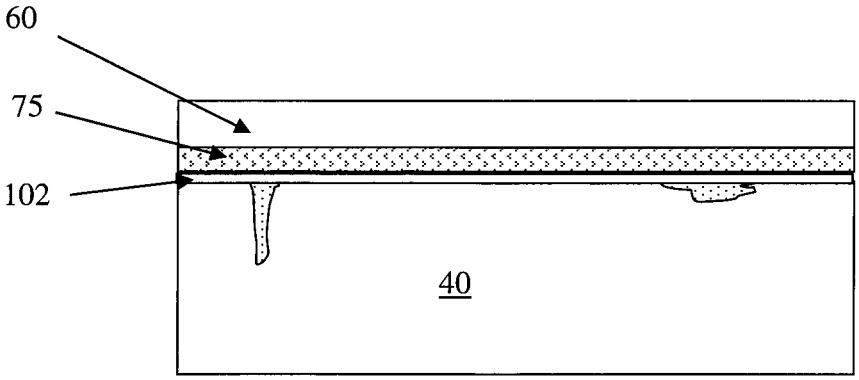

Referring to FIGS. 3-4D various embodiments of the invention are shown. A substrate is provided (step 110), and in accordance with one or more embodiments, the substrate may be inspected to determine its profile characteristics (step 112). While the substrate 40 may include a cementitious substrate, such as, a flooring, concrete flooring, concrete-based slab or flooring, wall, roof, counter, or any other type of surface or object that may be covered by a polishable overlay. That is, it should be appreciated that the substrate may include any type of surface over which an uncoupling membrane may be attached/adhered/connected to. Again, the substrate 40 may have flaws 42 as shown in FIG. 4A that need to be fixed to maintain integrity of the underlying substrate 40 and prevent further damage thereto.

If it is determined that the substrate 40 has flaws 42 that require repair, or if the substrate needs cleaning (step 114), then the substrate is repaired and/or cleaned (step 116). Again, as shown in FIG. 4B these flaws may be holes or cracks that may be filled with a filler material (e.g., a cementitious filler, acrylic-based filler, epoxy-based filler, etc.). While substrate 40 may need some flaws 42 repaired, the amount (extent) of repairs, labor required, and time to complete such repairs is reduced in the invention since use of an uncoupling membrane/mat 75 allows for some flaws or damage to remain in the substrate since the uncoupling membrane covers such flaws/damage. This is not the case when using a primer/sand broadcast layer that requires the substrate to be free of flaws, damage and/or debris. In the invention, if it is determined that the substrate 40 does not need repair or cleaning, these steps are avoided.

In accordance with the invention an uncoupling membrane 75 (also referred to as an uncoupling mat/plate, support mat/plate/membrane, decoupling mat/plate/membrane, underlayment mat/plate/membrane, and the like) is provided over the substrate 40 (step 130) as shown in FIGS. 4C-5B. Uncoupling membranes/mats are sheets of material (typically plastic) having a geometric pattern that create an air space between the underlying substrate (e.g., subfloor) and overlying facing materials (e.g., tiles). They are used between the underlying substrate and overlying facing materials to minimize or eliminate stresses, which may cause cracking or detachment of the facing material from the substrate. In doing so, the uncoupling membranes/mats isolate the overlying facing materials from the underlying substrate to allow independent movement between the two and limit the transfer of stresses.

The use of facing materials, such as, ceramic tiles, stone substrate, granite, slate, plastics, and the like, are known to provide an aesthetically pleasing appearance as well as durability and wear resistance. Polishable overlays have also gained popularity due to their ease of application and aesthetically pleasing appearance. It has now been found that the use of an uncoupling membrane 75 in combination with only a polishable overlay 60 provides superior adhesion and bonding results as compared to prior art methods that implement the use of primer/broadcast sand layers as discussed above in relation to FIGS. 1-2E.

In one or more embodiments of the invention, the uncoupling membrane 75 is composed of a rigid material that may have recesses, raised protrusion, and/or openings residing across and/or within the surface area of such membrane. The recesses may have any shaped internal sidewalls including, but not limited to, conical sidewalls, straight sidewalls, angled sidewalls, beveled sidewalls, stepped sidewalls, sidewalls having overhangs and/or dovetail protrusions, curved sidewalls, smooth sidewalls, roughened sidewalls, and the like, and even combinations thereof. Attached to the bottom of the uncoupling membrane 75 is a fabric-like mat 104. The uncoupling membrane 75 may have openings, slots, holes, etc. through its material to expose the underlying fabric-like mat 104 and/or to expose the underlying fabric-like mat 104 to a material that is to be deposited over the uncoupling membrane 75. In accordance with the invention, these openings, slots, holes, etc. expose the underlying fabric-like mat 104 to polishable overlay 60 that is to be deposited over the membrane 75.

Various different uncoupling membrane 75 designs may be implemented in the invention. For instance, in one or more embodiments, the uncoupling membrane 75 may be a sheet of plastic material having a number of recesses 76 formed across and within the uncoupling membrane (see FIGS. 5A-5B). Each recess 76 has sidewalls and a bottom wall composed of the uncoupling membrane material. Raised portions 74 of the uncoupling membrane/mat material reside between the recesses 76 with empty cavity regions 106 residing under the raised portions of the support plate. In other embodiments of the invention, these raised portions 74 may be a number of raised protrusions extending upward from the bottom surface of the membrane having a variety of different shapes and configurations (e.g., circular, semi-circular, elliptical, square, conical, column shaped, or any other geometric shaped raised protrusions having upward extending sidewalls and a top surface thereof, and the like). The recesses 76 (i.e., recess regions) of the uncoupling membrane 75 reside between, amongst, and across these raised protrusions portions 74 of the uncoupling membrane 75. These uncoupling membranes 75 may further be provided with a heating wire (heat wiring) that resides within the recess regions and around the raised portions 74, whereby the polishable overlay 60 may be deposited or poured over both the uncoupling membranes 75 and the heat wiring that resides meanderingly within the recessed regions of the membrane.

Still further, whether the uncoupling membrane 75 has recesses or raised protrusion each of these uncoupling mats may be provided with one or more different types of openings that extend through the uncoupling membrane material to expose the fabric-like mat 104 attached to the bottom of the uncoupling membrane 75. The openings traverse through the material of the uncoupling membrane and may include open slots, open channels, small openings in the bottom surface of the mat, pinhole openings, and the like. These openings may be between two or more recesses, between two or more raised protrusions, between and connect two or more recesses together, between and connect two or more raised protrusions together, and/or the openings may be any shaped opening residing in and traversing through the sheet material of the uncoupling membrane to expose the underlying fabric 104. In exposing the underlying fabric 104, it should be appreciated that the fabric 104 is exposed and visible from a top down view of the membrane 75 that is attached to the substrate 40.

Referring to FIG. 3, in step 130 the uncoupling membrane 75 is attached to substrate 40 using an adhesive. For instance, the uncoupling membrane 75 may be using mortar 102, preferably a thinset mortar, deposited over substrate 40 followed by providing the uncoupling membrane 75 over the mortar 102 layer (See, FIGS. 4C-4D). The mortar 102 impregnates the fabric-like mat 104 to secure the uncoupling membrane 75 to substrate 40.

Referring to FIG. 4D, once the uncoupling membrane 75 is attached and secured to the substrate 40, a polishable overlay 60 is deposited directly over and onto the uncoupling membrane 75 (step 136). The polishable overlay 60 may be any known, or to be developed, self-leveling layer including those having dual purposes, such as, for use as attractive interior wear surfaces or as high performance underlayments. The polishable overlay 60 may be a cement-based composition that includes one or more of the following additives and/or attributes: is a blend of cements, includes polymers, color and mineral aggregates, is pourable or pumpable, may be deposited in one or more steps, may be deposited to thicknesses of 1/16" to 3" (1.5 mm to 76 mm) in a single application, is polishable (if needed), provides a smooth coating (no need for polishing), may be accented with a variety of coloring systems (dyes, stains, etc.) and decorative finishes, the cured polishable overlay 60 has a high abrasion resistance.

In accordance with one or more embodiments, the polishable overlay may be a pourable, polishable cement-based material (e.g., Levelex DL) that provides high quality, fast drying, dual purpose, self-leveling, robust interior wear surface polished overlay finished product. Since the polishable overlay 60 is subsequently processed for preferred aesthetic overall resultant appearances, facing materials are typically not provided over this polishable overlay 60, although they may be. In one or more embodiments the polishable overlay (e.g., a self-leveling polishable overlay) may be deposited or poured to about $5/8^{th}$ inch thickness, although it should be appreciated that various other less or more polishable overlay thickness dimensions are suitable in the invention.

Figure 5A:
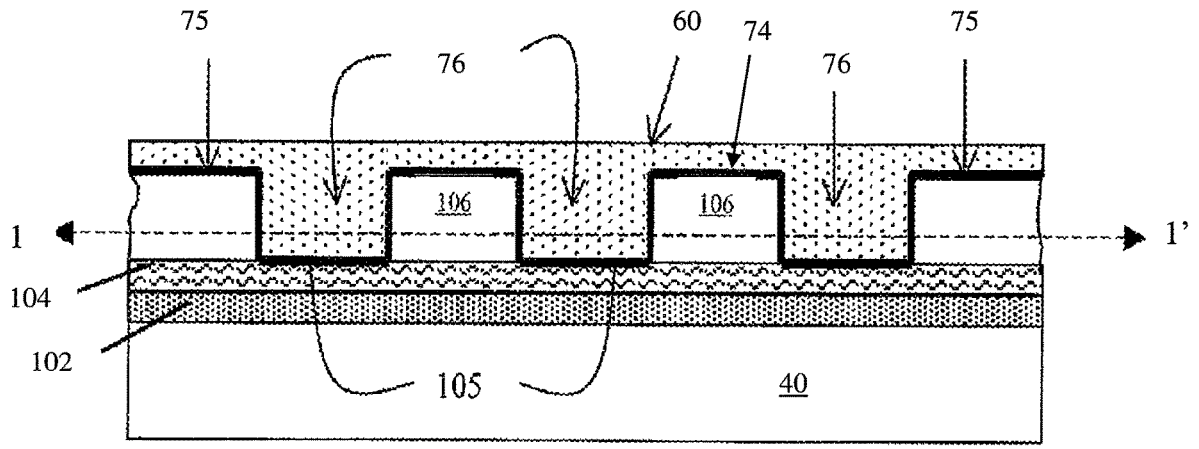
FIGS. 5A-5B illustrate polishable overlays applied directly over different uncoupling mats in accordance with the invention.
Figure 5B:
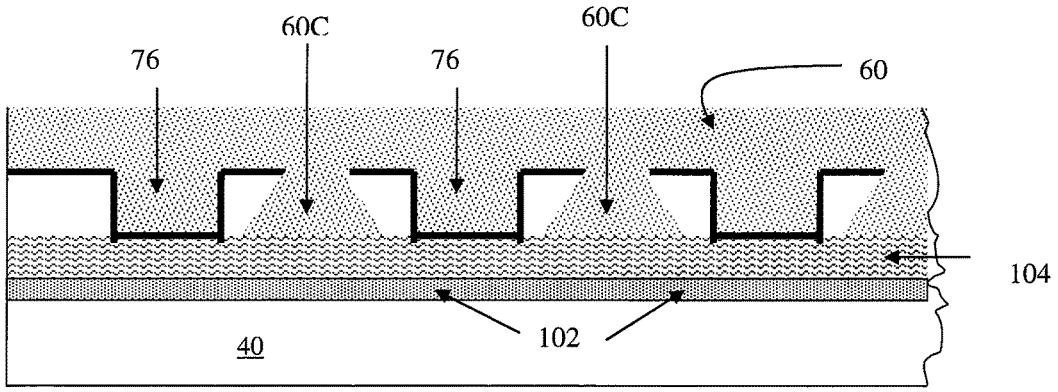

Referring to FIGS. 4D-5B, once mixed the polishable overlay 60 is directly deposited (i.e., poured) over and onto the surface of the uncoupling membrane 75, such that, it fills any recesses 76 or openings therein (see, e.g., FIG. 5A). The polishable overlay 60 may be deposited in an amount sufficient to fill any recesses, cavities or openings in the membrane 75 as well as provide a suitable thickness of the polishable overlay 60 over a top surface area of the uncoupling membrane 75. In one or more embodiments, the polishable overlay 60 may be deposited in an amount sufficient to fill any recesses, cavities or openings in the membrane 75, as well as provide a thickness of about 1/16" to 3" (1.5 mm to 76 mm) over the top surface of the uncoupling membrane 75. The polishable overlay 60 may be deposited in a single application, or in multiple applications to provide one or more layers of polishable overlay 60.

In those uncoupling mats 75 having openings therein, upon being deposited the polishable overlay 60 extends into such openings residing within and across the uncoupling membrane 75. In doing so, the polishable overlay 60 may form, for instance, conical pillars of polishable overlay material 60C within these openings (see, e.g., FIGS. 5A and 5B). In certain embodiments the uncoupling membrane 75 may have the underlying fabric-like mat 104 exposed through these plurality of openings. In these embodiments, as the polishable overlay 60 is deposited over the uncoupling membrane (having openings exposing fabric-like mat 104), the polishable overlay 60 directly deposits (pours) into these openings to contact and bond with the exposed underlying fabric 104.

When an uncoupling membrane 75 having gripping components thereon or fabricated as part of the membrane, such gripping components help to enable greater bonding with the polishable overlay. For instance, in those membranes 75 having recesses or raised protrusions residing across the surface thereof, these recesses/protrusions enable greater bonding with the polishable overlay as compared to the conventional bonding to an epoxy primer/sand broadcast layer. The recesses, raised protrusion, and/or openings residing in or across the uncoupling membrane 75 may have overhangs, ridges, or any type of gripping component (i.e., gripping feature) or overhanging extension that enables the polishable overlay to adhere thereto and securely bond to such uncoupling membrane 75.

In accordance with the invention, no epoxy primer/sand broadcast layer 50 is provided over the uncoupling membrane 75. As such, the prior art steps and time taken to prepare the floor for the primer, apply the primer, apply the broadcast sand, allow for such layers to cure, followed by removal of any residual sand, are all eliminated by the various embodiments of the invention. This saves a significant amount of time (e.g., 12-36 hours, or more or less) and worker labor. Since only the polishable overlay 60 is provided over the uncoupling membrane 75, once it is dried or cured, any subsequent processing thereto may then take place (e.g., subsequent polishing steps).

Once the polishable overlay residing over the uncoupling membrane 75 is completely cured, the overlay layer is polished, preferably using a polishing device. In one or more embodiments a planetary grinder may be used to polish the overlay to provide the resultant flooring with desired characteristics such as, for instance, flatness, shine, coloring, etc. Since use of a primer layer, an epoxy primer layer, and an epoxy primer/broadcast sand layer are all avoided (not performed or not a required processing step) in accordance with the invention, the polishing step of the invention does not encounter either pinholes due to lack of primer (since no primer is deposited under the polishable overlay) or visible sand segregation imperfections (since no sand is deposited under the polishable overlay). Also, in the process of polishing the overlay the uncoupling membrane 75 provides flexibility between the substrate and overlay to reduce shear stresses generated by the polishing device. This in turn reduces stress applied to the overlay during polishing, thereby reducing cracking and/or detachment of the overlay, and in particular, of the finished polished overlay product (i.e., the resultant polished overlay flooring).

The resultant flooring of the invention has a very strong mechanical bond between the polishable overlay and the uncoupling membrane 75 (with or without openings therein). When an uncoupling membrane 75 having openings therein and/or gripping components is implemented, the mechanical bond between the polishable overlay and the uncoupling membrane 75 is very strong due to adhesion between the polishable overlay and the exposed fabric-like mat 104 (which in turn is adhered to substrate 40) and/or gripping components. The polishable overlay penetrates through the openings to adhere to the fabric-like mat, as well as portions of such polishable overlay adhering to top surface areas of the uncoupling membrane 75 and to bottom surface areas of the membrane 75 material residing within such openings. The combination of these bonds between the polishable overlay and the uncoupling membrane 75 provide superior adhesion as compared to prior art techniques. Further since bonding between a broadcast sand layer and a polishable overlay is avoided in the invention, cracking, hollow spots and/or delamination issues are further avoided in the resultant flooring of the invention. These issues of cracking, hollow spots and/or delamination are even further avoided in those embodiments of the invention implementing an uncoupling membrane 75 having openings therein.

While not meant to be limiting, an uncoupling membrane 75 suitable for use in the present invention may include the uncoupling membrane/mat disclosed in U.S. Pat. No. 9,016,018, the entirety of which is incorporated herein by reference (hereinafter "the '018 patent"). The uncoupling membrane/mat of the '018 patent meets/exceeds ANSI 118.12 for anti fracture, which eliminates transmission of cracks up to ⅛" in substrate/flooring 40 into the polishable overlay. The uncoupling membrane/mat of the '018 patent also disperses transmission of moisture vapor from substrate/flooring 40 to prevent delamination and cracking from occurring due to excess moisture vapor emission rate. This eliminates the step of having to use another epoxy that controls high moisture vapor emission rate.

Tests were performed and the resultant flooring of the invention, after a typical polishable overlay cure time, showed no signs of cracking, hollow spots and/or delamination after having heavy operating equipment (i.e., fork-truck) being driven over such flooring. Testing methods included securing an uncoupling membrane 75 to substrate 40 followed by providing the polishable overlay directly over the uncoupling mat 75 on the same day. The resultant flooring showed no signs of cracking, hollow spots and/or delamination after extended periods of heavy traffic being provided over such flooring.

As compared to prior art approaches of depositing a polishable overlay, the present methods, polished overlay floorings and systems for providing polishable overlays directly over an uncoupling mat advantageously decrease the installation time by saving at least 24 hours, which was required to allow the prior art epoxy primer/sand broadcast layer to cure. Additional time is also saved due to the decreased processing steps of the invention.

For instance, prior to deposition, the epoxy/sand broadcast layer requires an aggressive grinding of the existing concrete floor producing a CSP of 3-5 to allow the epoxy primer to properly adhere to the floor. This step is avoided in the present invention since the uncoupling membrane bonds to the existing flooring, so long as it is free of bond inhibiting agents grinding of the flooring is not needed. The installer of the uncoupling mat is able to save time and money by not having to prepare the flooring as aggressively as he would have to for adhesion of an epoxy primer/sand broadcast layer. Further time and money are saved since the invention does not require the removal of excess sand created from sand broadcasting, which is a time-consuming process that also leaves a larger potential for human error and failures due to the possibility of not removing all loose sand and causing delamination.

The various embodiments of the invention also provide environmental safety advantages by eliminating several steps that may introduce health hazards (e.g., silica) into the air. These airborne particulates are avoided since there is no need to grind the existing floor by either shot blasting or grinding. They are also avoided since there is no need to sweep and/or vacuum up excess sand broadcast onto the epoxy bond coat since this step is eliminated in the invention. The invention also decreases costs since the materials of the epoxy primer/sand broadcast layers are avoided. Since cracks and delamination are avoided in accordance with the invention, the use of a polishable overlay deposited directly over an uncoupling membrane may also improve or provide sound control in the resultant flooring, as compared to polishable overlay floorings having epoxy primer/sand broadcast layers which are susceptible to cracking, hollow spots and/or delamination that leads to reduced sound control. The invention is suitable for use in both interior (indoor) and exterior (outdoor) applications.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A method of installing a polishable overlay comprising:
providing a substrate;
securing an uncoupling membrane to the substrate;
depositing only a polishable overlay directly over and contacting the uncoupling membrane to secure the polishable overlay to the substrate, the polishable overlay filling any voids in the uncoupling membrane and being deposited over the uncoupling membrane to a thickness residing above a top surface of the uncoupling membrane; and
polishing a top surface of the deposited polishable overlay to provide a polished overlay, wherein the uncoupling membrane reduces stresses applied to the polishable overlay during polishing.

2. The method of claim 1 wherein the substrate comprises a concrete-based flooring.

3. The method of claim 1 wherein the uncoupling membrane includes a number of recesses residing across a surface area thereof, the polishable overlay filling the number of recesses.

4. The method of claim 3 wherein the uncoupling membrane further includes a number of openings residing across the surface area thereof, the polishable overlay depositing into the number of openings.

5. The method of claim 4 wherein the uncoupling membrane further includes a fabric-like mat attached to an underside thereof, the number of openings exposing the fabric-like mat whereby the polishable overlay contacts and bonds to the fabric-like mat through the number of openings.

6. The method of claim 1 wherein the uncoupling membrane includes a number of raised protrusions residing across a surface area thereof with recess regions residing between the raised protrusions, the polishable overlay filling the recess regions.

7. The method of claim 6 wherein the uncoupling membrane further includes a number of openings residing across the surface area thereof.

8. The method of claim 7 wherein the uncoupling membrane further includes a fabric-like mat attached to an underside thereof, the number of openings exposing the fabric-like mat whereby the polishable overlay contacts and bonds to the fabric-like mat through the number of openings.

9. The method of claim 1 wherein the polishable overlay is directly poured onto the uncoupling membrane without a primer layer residing between the polishable overlay and the uncoupling membrane.

10. The method of claim 1 wherein the polishable overlay is directly poured onto the uncoupling membrane without an epoxy primer layer residing between the polishable overlay and the uncoupling membrane.

11. The method of claim 1 wherein the polishable overlay is directly poured onto the uncoupling membrane without an epoxy primer/broadcast sand layer residing between the polishable overlay and the uncoupling membrane.

12. The method of claim 1 wherein use of an epoxy layer and a broadcast sand layer are avoided.

13. The method of claim 1 further including inspecting the substrate for flaws, and repairing identified flaws of the substrate prior to securing the uncoupling membrane to the substrate.

14. The method of claim 1 wherein the substrate comprises a cementitious substrate, the method further including;
applying a mortar over the cementitious substrate;
providing the uncoupling membrane over the mortar to secure the uncoupling membrane to the cementitious substrate; and
pouring the polishable overlay directly over and contacting the uncoupling membrane to secure the polishable overlay to the cementitious substrate without use of a primer/broadcast sand layer.

15. The method of claim 14 further including inspecting the cementitious substrate for flaws, and repairing identified flaws of the cementitious substrate prior to applying the mortar and the uncoupling membrane.

16. The method of claim 15 wherein the polishable overlay fills any voids in the uncoupling membrane and is deposited over the uncoupling membrane to the thickness of 1.5-76 mm over the top surface of the uncoupling membrane.

17. The method of claim 1 wherein the substrate, the uncoupling membrane, and the polished overlay together provide a finished polished overlay flooring, the reduced stresses reducing cracking and detachment of the finished polished overlay flooring.

18. A system of an overlay placement comprising:
a substrate;
an uncoupling membrane secured to the substrate; and
a polishable overlay residing directly over and contacting the uncoupling membrane to secure the polishable overlay to the substrate without use of a primer/broadcast sand layer, the polishable overlay filling any voids in the uncoupling membrane and being deposited over the uncoupling membrane to a thickness residing above a top surface of the uncoupling membrane.

19. A polished overlay flooring comprising:
an existing floor;
an uncoupling membrane secured to the existing floor;
a polishable overlay residing over and directly contacting the uncoupling membrane to secure the polishable overlay to the existing floor without use of a primer/ broadcast sand layer, the polishable overlay filling any voids in the uncoupling membrane and being deposited over the uncoupling membrane to a thickness residing above a top surface of the uncoupling membrane.

20. The method of claim 1 wherein the polishable overlay comprises a self-leveling polishable overlay.

* * * * *